United States Patent [19]

Kamp et al.

[11] 4,038,623

[45] July 26, 1977

[54] ELECTROMAGNET WITH TERMINALS

[75] Inventors: Eugene L. Kamp; Charles D. Visos, both of St. Louis County, Mo.

[73] Assignee: Emerson Electric Co., St. Louis, Mo.

[21] Appl. No.: 683,644

[22] Filed: May 6, 1976

[51] Int. Cl.[2] ..... H01F 7/08

[52] U.S. Cl. ..... 335/219; 335/196

[58] Field of Search ..... 335/196, 202, 132, 219, 335/209, 133, 220, 186, 2; 251/129

[56] References Cited

U.S. PATENT DOCUMENTS

| | | | |
|---|---|---|---|
| 2,105,931 | 1/1938 | Roe | 335/219 |
| 2,458,014 | 1/1949 | Matson | 335/186 |
| 3,287,675 | 11/1966 | Woods | 335/202 |
| 3,998,425 | 12/1976 | Braucksiek | 335/202 |

*Primary Examiner*—Harold Broome

*Attorney, Agent, or Firm*—Paul A. Becker, Sr.

[57] ABSTRACT

An electromagnet with terminal means for series connecting the electromagnet, a conventional thermocouple, and an external safety switch. One end of a first terminal is adapted to provide low contact resistance when connected to the hot side of the thermocouple and the other end of the first terminal is adapted to be connected to the safety switch. Separated from the first terminal by an insulative base and integral with the base to which a yoke and winding are secured, are a second terminal, adapted to be connected at one end to the safety switch and connected at its other end to one end of the winding, and a third terminal, adapted at one end to be connected to the housing of a control device in which the electromagnet is assembled and connected at its other end to the other end of the winding.

10 Claims, 6 Drawing Figures

ELECTROMAGNET WITH TERMINALS

This invention relates to thermocouple-energizd electromagnets employed in a safety cutoff valve device and electrically connected in series with a thermocouple and an exterior safety switch, and particularly to an improved construction of an electromagnet for facilitating such series connection.

Certain gas appliances, such as gas fired water heaters, generally employ a gas burner control system which is effective to cut off the flow of gas to both a pilot burner and a main burner in the event that the pilot burner flame is extinguished or an abnormally high temperature occurs in the appliance. For many years, this has been accomplished by electrically connecting in series, a pilot burner heated thermocouple, a temperature responsive safety switch, and a thermocouple-energized electromagnet controlling a safety cutoff valve device disposed in the gas supply conduit between a gas source and the burners.

When the safety switch is of a type adapted to be connected into the above series circuit by two electrical leads, the prior art arrangements for effecting the series connection have generally included a coupling means disposed in the safety cutoff valve device. Such a coupling means has generally included a pair of conductors insulated from each other and disposed in the safety cutoff valve device so that one of the conductors contacts one of the coaxial terminals, of the thermocouple and the other conductor contacts a terminal connected to one end of the electromagnetic winding. Two leads or terminals connected to the conductors extend exteriorly of the safety cutoff valve device for connection to the safety switch.

Among the objections to the prior art arrangements is that the safety switch protection can be negated by removing the coupling means. That is to say, in some prior art arrangements, the coupled terminal of the thermocouple and the coupled terminal of the electromagnetic winding are axially aligned and sufficient closely spaced so that removal of the coupling means therebetween enables the thermocouple terminal to be subsequently directly connected to the electromagnetic winding terminal. Such removal of the coupling means and subsequent direct connection to the electromagnetic winding which might be done, for example, to eliminate nuisance shutdowns of the system caused by a malfunctioning safety switch, enables energizing of the electromagnet without the high temperature protection provided by the safety switch.

Another objection is that, in some previous arrangements, the resistance of the series circuit is dependent upon the degree of surface contact between separate metal parts clamped together when the coupling means is assembled to the safety cutoff valve device. Since it is imperative that the circuit resistance be extremely low because of the limited power generated by the thermocouple, more positive circuit connections are desirable.

It is an object of this invention to provide, in a control device, a generally new and improved electromagnet adapted to be electrically connected in series with a thermocouple and controlling circuit means, wherein terminal means for facilitating such series connection are constructed and arranged in such a manner so as to provide a low resistance circuit and to preclude direct connection of the thermocouple to the electromagnetic winding.

A further object is to provide an electromagnet, as in the preceding paragraph, in which a first terminal is adapted to be connected to the thermocouple and to the controlling circuit means, a second terminal is adapted to be connected to the controlling circuit means and to one end of the electromagnetic winding, and a third terminal is adapted to be connected to the other end of the winding and, by means of a grounding screw, to the body of the control device; in which an insulative base supports a yoke, the winding, and the terminals; and in which the first and second terminals are insulated from each other by the base so that direct connection of the thermocouple to the winding in precluded if the first terminal is removed.

A further object is to provide an electromagnet, as in the preceding paragraph, in which the first terminal is deformable when connected to coaxial terminal means of the thermocouple so as to provide relatively high contact pressure therebetween, and in which at least the second the third terminals are integral with the base.

A further object is to provide an electromagnet, as in the penultimate paragraph, wherein the yoke and all terminals are integral with the base.

Further objects and advantages will appear from the following description when read in conjunction with the accompanying drawings.

Figure 1:
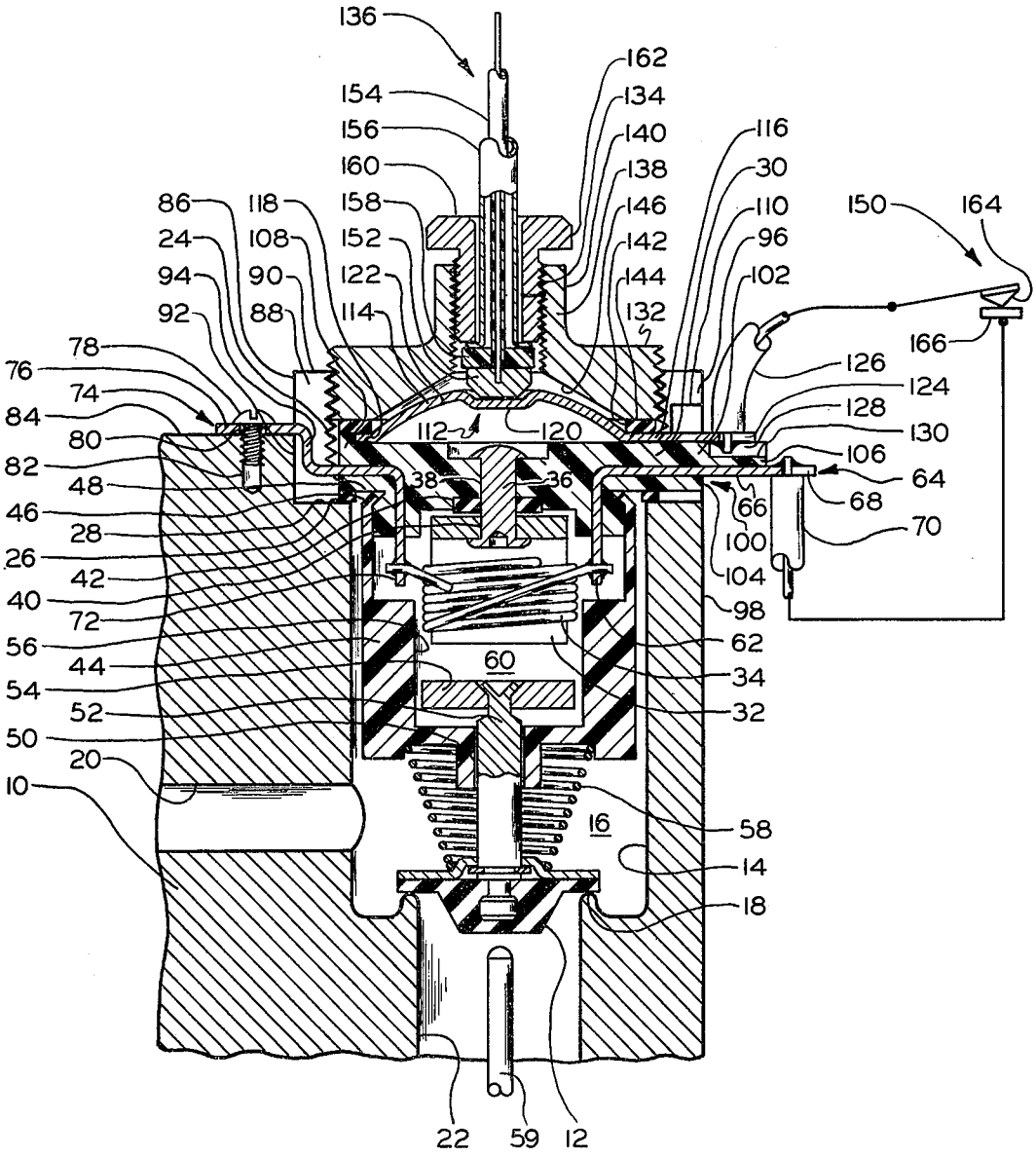
FIG. 1 is a fragmentary cross-sectional view of a control device embodying an electromagnet constructed in accordance with the present invention and shown with a thermocouple and external controlling circuit means connected thereto.

Referring to FIG. 1, the body of a gas valve device is shown fragmentarily at 10. A biased closed safety cutoff valve 12 is disposed in the lower portion 14 of a cavity 16 and cooperates with a seat 18 formed therein to control the flow of gas from an inlet passage 20 to a main passage 22.

Cavity 16 includes an internally threaded upper potion 24 of slightly larger diameter than the lower portion 14. Spaced by a gasket 26 from a horizontal shoulder 28 formed between lower portion 14 and upper portion 24 of cavity 16 is a generally cylindrical insulative base member 30 constructed of any suitable dielectric material. A U-shaped yoke 32 of magnetic material and having a winding 34 is rigidly attached to the base 30 by a rivet 36 extending through a central bore 38 in the base 30 and an axially aligned aperture 40 in the yoke 32. A gasket 42, disposed around the rivet 36 between the underside of the base 30 and yoke 32, and the gasket 26, between shoulder 28 and the base 30, seal the body cavity 16 against gas leakage.

An insulative cup-shaped cover member 44, constructed of a suitable dielectric material, has an open end provided with inwardly extending projections 46 which are snapped into an annular groove 48 in a reduced cylindrical underside portion of the base 30 to provide a detachable connection to the base 30. Extending through a central aperture 50 in the closed end of cover member 44 is a stem 52, one end of which is connected to the valve 12 and the other end of which is connected to a generally rectangular armature disc 54. A portion of the inside walls 56 of cover 44 are also generally rectangular so that armature disc 54 is prevented from rotating when it reciprocates in cover member 44. A compression spring 58 between the bottom of cover 44 and valve 12 biases the valve 12 on its seat 18 and the armature disc 54 away from the yoke 32 so that the valve 12 will be closed by spring 58 unless the armature disc 54 is held to the yoke 32 due to the winding 34 being energized, or unless armature disc 54 is manually pushed upward into contact with the yoke 32 by any suitable means, as by a push rod 59 which, when pushed upwardly, engages the valve 12.

Extending downwardly from the base 30 into a cavity 60 defined by the base 30 and the cover 44 is one end 62 of an electric terminal 64 which is insert-molded into the base 30. One end of winding 34 is secured, as by soldering, to end 62 of terminal 64. The other end 66 of terminal 64 extends radially outwardly from the base 30 and is provided with a U-shaped slot 68 to facilitate connecting, as by soldering, an external lead 70. Also extending downwardly from base 30 into the cavity 60 is one end 72 of another electric terminal 74, also integral with the base 30. The other end of winding 34 is secured, as by soldering to end 72 of terminal 74. The other end 76 of terminal 74 extends radially outwardly and is secured to the valve body 10 by means of a screw 78 passing through a hole 80 in the end 76 of terminal 74 and into a threaded hole 82 in the valve body 10.

As shown more clearly in FIG. 2, the upper threaded portion 24 of valve body cavity 16 extends upwardly from the shoulder 28, which is spaced below a top surface 84 of the valve body 10, into a thin-walled circular boss 86 integral with and extending slightly above the top surface 84 of the valve body 10. A slot 88 extends upwardly from the shoulder 28 through the top surface 90 of the boss 86. Slot 88 has an outer wall 92 defined by the valve body 10 extending to the top surface 84 and an open portion extending radially through the circular boss 86 to provide a transverse opening for an intermediate portion 94 of terminal 74.

Another alot 96, radially spaced from slot 88, extends upwardly from the shoulder 28 through the top surface 90 of the boss 86 and radially outwardly to an outer surface 98 of valve body 10. Disposed within slot 96 is a relatively narrow tab 100, integral with and extending radially outwardly from the periphery of base 30. Tab 100 has a portion 102 which extends radially outwardly a sufficient amount so as to provide a surface 104 flush with the surface 98 of valve body 10. Tab 100 also has a smaller second portion 106 extending radially outwardly beyond its surface 104 for a purpose to be hereinafter described.

Extending upwardly and radially inwardly from the periphery of base 30 is a narrow annular projection 108. The projection 108 also extends into tab portion 102 and terminates in a pair of opposed wider and higher projections 110. Projections 108 and 110 provide means for retaining a terminal 112 and for electrically insulating terminal 112 from the valve body 10.

Terminal 112, formed from a very hard material, such as extra hard phospher bronze, and of a thickness approximately equal to the height of projection 110, is comprised of a generally conical-shaped portion 114 and a relatively narrow tab portion 116 extending radially outwardly from its periphery. The conical-shaped portion 114 has a generally flat peripheral portion 118, a generally flat recessed central portion 120, and a tapered portion 122 extending upwardly between portions 118 and 120. The above described construction of terminal 112 enables it to be deformed when a sufficiently high downward force is applied to its central portion 120 by means to be hereinafter described.

Tab portion 116 of terminal 112 includes a U-shaped slot 124 to facilitate connecting, as by soldering, an external lead 126 as shown in FIG. 1. The previously described second portion 106 of tab 100 of the base 30 includes a U-shaped shallow recess 128 disposed directly below the terminal slot 124 and having a bottom wall 130. This arrangement minimizes the possibility of electrically shorting terminals 64 and 112 when solder connecting external leads 70 and 126 in terminal slots 68 and 124, respectively. It should be noted that if the termination of terminals 64 and 112 are of a quick connect construction, such terminals illustrated as terminals **64*a* and 112*a* in FIG. 3, and conventional insulated female connectors (not shown) are connected thereto, the second portion 106 of tab 100** can be omitted.

A metallic thermocouple connector member 132 has external screw threads for connection to the internally threaded upper portion 24 of valve body cavity 16, and a central screw threaded bore 134 extending therethrough to threadedly receive, as shown in FIG. 1, coaxial terminal means 136 of a conventional thermocouple (not shown). Connector member 132 also has an integral projecting boss 138 having a pair of opposed, flat, parallel sides 140 to facilitate securing member 132 into the threaded upper portion 24 by suitable tool means.

Connector member 132 is spaced from terminal 112 by a narrow circular gasket 142 of any suitable dielectric material which is disposed between the flat peripheral portion 118 of terminal 112 and a flat peripheral portion 144 on the underside of connector member 132, gasket 142 extending radially outwardly to the threads of the upper threaded portion 24 as shown in FIG. 1. The underside of connector member 132 also has an upwardly tapered surface 146 extending from the flat peripheral portion 144 to the central bore 134. The angle of the taper is sufficient to insure that connector member 132 and terminal 112 are not in contact with each other.

Figure 2:
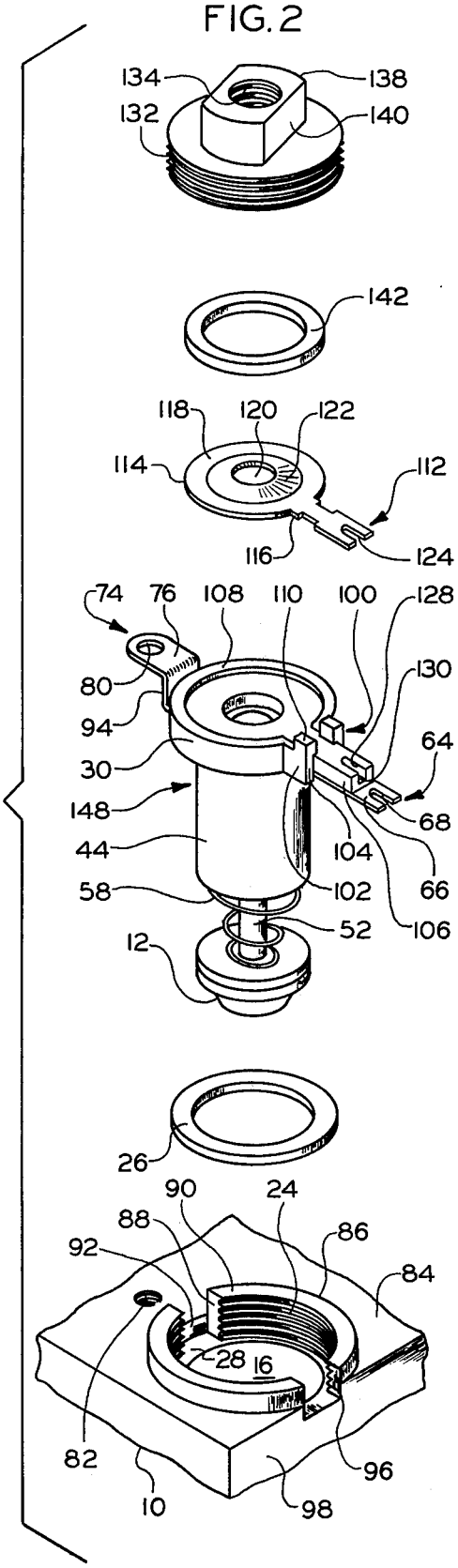
FIG. 2 is an exploded perspective view of FIG. 1 on a reduced scale and with the thermocouple and external controlling circuit means removed.

Valve 12, spring 58, armature disc 54, and stem 52 are secured to the cover 44, and the cover is attached to the base 30 which includes the yoke 32, winding 34, and terminals 64 and 74, to form an assembly indicated generally at 148 in FIG. 2. After inserting gas sealing gasket 26 on shoulder 28 in the valve body cavity 16, assembly 148 is inserted in cavity 16 and secured therein by the ground screw 78 which passes through hole 80 in terminal 74 and into threaded hole 82 in the valve body 10. Terminal 112 is then placed on base 30 and is centered thereon by projections 108 and 110. Electrically insulative gasket 142 is then placed on the top of terminal 112. Finally, the thermocouple connector member 132 is threadedly secured to the upper threaded portion 24 of the valve body cavity 16 with sufficient tightening torque being applied to connector member 132 to compress gas sealing gasket 26 to effect sealing of cavity 16. The gas valve device is then ready for connection to a conventional thermocouple having coaxial terminal means 136 and to a temperature responsive safety switch 150 or similar controlling circuit means, such connections being shown in FIG. 1.

In FIG. 1, the coaxial terminal means 136 of a conventional thermocouple includes a conductive head portion 152 having a generally flat bottom surface and fixedly attached to a stripped end of an insulated lead 154 connected at its other end to one side of a thermocouple junction (not shown). The lead 154 extends coaxially inside a tubular lead 156 which is connected at one end to the other side of the thermocouple junction. The other end of tubular lead 156 is flared and an insulating washer 158 separates the flared end of tubular lead 156 from the conductive head portion 152. The tubular lead 156 extends through a hollow metal nut 160 threadedly engaged in threaded bore 134 of connector member 132.

It is a generally accepted practice to tighten the terminal means of a conventional thermocouple finger tight and then an additional one-quarter turn with a suitable tool. Accordingly, as nut 160 is threadedly advanced, finger tight, into connector member 132, nut 160 clamps the flared end of tubular lead 156 between its bottom surface and the insulating washer 158 and also forces the conductive head portion 152 downwardly into contact with terminal 112. Should conductive head portion 152 be axially misaligned with nut 160, the flat recessed central portion 120 of terminal, 112 and the tapered sides leading therein from the top of the portions 122 of terminal 112 are effective to correct such misalignment and thereby insure that subsequent downward force applied to terminal 112, as nut 160 is advanced an additional one-quarter turn, will be applied to the central portion 120 of terminal 112.

When the nut 160 is advanced the aforementioned one-quarter turn, a relatively high downward force is applied against the central portion 120, causing a downward movement of the central portion 120 and a slight bowing of the tapered portion 122, as shown in FIG. 1, thereby providing relatively high contact pressure between the bottom surface of conductive head portion 152 and the central portion 120 of terminal 112. This relatively high contact pressure and the fact that the mating surfaces of the conductive head portion 152 and central portion 120 are generally flat so as to provide maximum surface contact therebetweeen, combine to provide an extremely low contact resistance between the conductive head portion 152 and central portion 120.

The central portion 120 of terminal 112 is initially sufficiently vertically spaced from the top surface of base 30 to allow considerably more downward movement of central portion 120 should nut 160 be turned more than one-quarter turn. However, to preclude central portion 120 from contacting base 30, the upper end of nut 160 is provided with a radially extending shoulder portion 162, the underside of which cooperates with the top surface of the boss 138 of connector member 132 to limit the downward movement to a value less than that which would cause central portion 120 to contact base 30. This arrangement prevents a considerably high downward force from being applied to the center of base 30, which force would tend to break the base 30.

To complete the system of FIG. 1, the safety switch 150, having normally closed contacts 164 and 166, is connected to leads 70 and 126. The safety switch 150, located so as to be responsive to the temperature of the medium being controlled, can be any conventional safety switch having low contact resistance and responsive to a predetermined temperature set point at which contacts 164 and 166 are opened.

To initiate operation of the system, armature disc 54 is manually pushed upwardly by push rod 59 into contact with the yoke 32. This raises valve 12 off its seat 18 and permits gas to flow from the inlet passage 20, through valve body cavity 16, and through main passage 22 to a pilot burner (not shown). When sufficient energy is generated by the thermocouple, whose tip is impinged by the pilot burner flame, the push rod 59 can be released and the armature disc 54 is held in contact with the yoke 32 by winding 34 which is energized through the following circuit: From one side of the thermocouple junction, lead 154, conductive head portion 152, terminal 112, external lead 126, safety switch contacts 164 and 166, external lead 70, terminal 64, winding 34, terminal 74, ground screw 78, valve body 10, connector member 132, nut 160, and lead 156 to the other side of the thermocouple junction. If the safety switch contacts 164 and 166 open or the pilot flame goes out, the above series circuit is deenergized and the valve 12 closes under the bias of spring 58.

The above described arrangement thus provides an extremely low resistance thermoelectric circuit, primarily due to the construction of terminal 112 and the positive connection of terminal 74 to valve body 10. Also, the arrangement insures that conductive head portion 152 cannot be directly connected to the electromagnet winding 34 even if terminal 112 is removed, such direct connection being precluded primarily due to the ungrounded end of winding 34 being connected to terminal 64 which is insulated by base 30 from conductive head portion 152.

Reference is now made to modifications illustrated in FIGS. 4, 5, and 6, wherein only the structure associated with the modifications will be described, and wherein the same reference numberals are utilized for the same parts described above in connection with FIGS. 1, 2, and 3.

Figure 4:
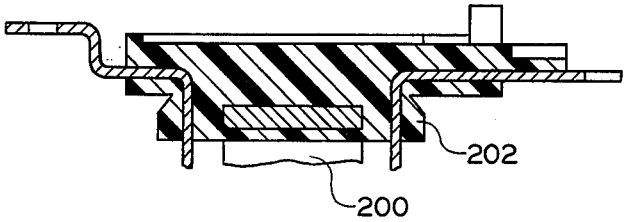
FIG. 4 is a fragmentary cross-sectional view showing an alternalte construction of the electromagnet base and yoke assembly of FIG. 1 wherein the yoke is insert-molded.

In FIG. 4, a yoke 200, similar to yoke 32 except it has no central aperture, is integrally molded with a base 202 which is similar to base 30 except it has no central bore. When this arrangement is utilized, rivet 36 and gas sealing gasket 42, shown in FIG. 1, are eliminated, thus reducing the amount of passages that must be sealed to prevent gas leakage from valve body cavity 16.

Figure 5:
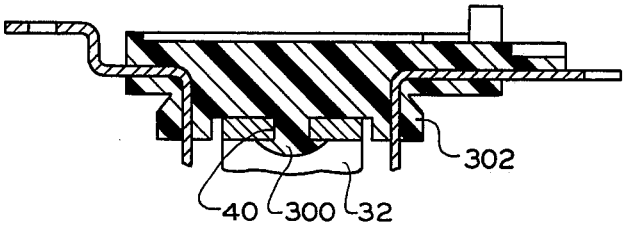
FIG. 5 is a fragmentary cross-sectional view showing another alternate construction of the electromagnet base and yoke assembly of FIG. 1 wherein the yoke is sonic welded to the base.

Another construction whereby rivet 36 and gasket 42 are eliminated is shown in FIG. 5. In FIG. 5, a small circular boss 300 extends downwardly from the underside of a base 302 through the aperture 40 in yoke 32. The boss 300 is then sonic welded to secure yoke 32 to the base 302.

Figure 3:
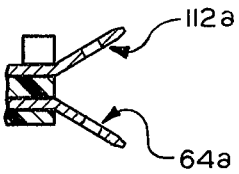
FIG. 3 is a fragmentary cross-sectional view showing an alternate construction of the electromagnet base and terminals of FIG. 1.

It is to be noted that either of the above described alternate means of attaching the yoke to the base can be utilized in the construction shown in FIGS. 1, 2, and 3, with no other construction changes required.

Figure 6:
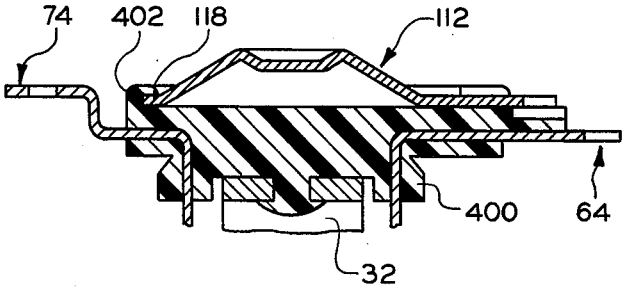
FIG. 6 is a fragmentary cross-sectional view showning an alternate construction of the electromagnet base, yoke, and terminal assembly of FIG. 1 wherein all terminals and the yoke are integral with the base.

Referring now to FIG. 6, terminals 64, 74, and 112, and yoke 32 are integral with a base 400. Extending upwardly and radially inwardly from the periphery of base 400 is a narrow annualar projection 402, similar to the previously described annual projection 108 but somewhat higher. Projection 402 is sonic welded over the flat perpheral portion 118 of termianal 112, thereby retaining terminal 112 and also providing means for electrically insulating terminal 112 from the flat peripheral portion 144 on the underside of connector member 132, shown in FIG. 1, and thus negating the need for insulative gasket 142. Yoke 32 is illustrated as being sonic welded to base 400 in the same manner as in FIG. 5, it being understood that the yoke and base connection could alternately be as shown in FIG. 4.

The modification illustrated in FIG. 6, in addition to reducing the amount of passages that must be sealed to prevent gas leakage from valve body cavity 16, also provides a more compact construction which simplifies assembly of the electromagnet into the valve body 10.

While the invention has been illustrated and described in detail in the drawings and foregoing description, it will be recognized that many other changes and modifications will occur to those skilled in the art. It is therefore intended, by the appended claims, to cover any such changes and modifications as fall within the true spirit and scope of the invention.

We claim:

1. In a control device adapted to be energized by a thermocouple and to be connected in circuit with controlling circuit means, a housing having an opening therein comprising a lower portion and a threaded upper portion;

thermocouple connector means threadedly engaged to said upper portion of said opening having an internally threaded bore for receiving coaxial terminal means of said thermocouple;

a first electric terminal spaced from said connector means and said housing having one end in said opening in alignment with said bore for connection to one terminal of said thermocouple terminal means and having another end extending externally of said opening for connection to said controlling circuit means;

an insulative base disposed in said opening having an upper portion providing means for retaining said first electric terminal;

a cover member having an open end and a closed end and having its open end connected to a bottom portion of said base and defining a cavity therewith;

a magnetic core member fixed to said base;

a winding on said core member;

said core member and said winding extending into said cavity;

a second electric terminal extending through said base and having one end extending externally of said opening for connection to said controlling circuit means and having another end extending into said cavity and connected to one end of said winding; and a third electric terminal extending through said base and having one end extending externally of said opening and attached to said housing and having another end extending into said cavity and connected to the other end of said winding.

2. The control device claimed in claim 1 wherein said one end of said first electric terminal comprises a flexible conical-shaped portion extending upwardly to a generally flat recessed central portion, said conical-shaped portion being spaced from said upper portion of said base and being deformed when said recessed central portion is moved toward said upper portion of said base by said one terminal of said thermocouple terminal means.

3. The control device claimed in claim 2 including means for limiting said movement of said recessed central portion so as to prevent said recessed central portion from contacting said upper portion of said base.

4. The control device claimed in claim 1 wherein said base, said magnetic core member, and said second and third electric terminals form an integral assembly.

5. The control device claimed in claim 1 wherein said base, said magnetic core member, and said electric terminals form an integral assembly.

6. The control device claimed in claim 1 wherein said housing has first and second transverse openings therein extending from said opening in said housing, said first and second electric terminals extending through said first transverse opening and said third electric terminal extending through said second transverse opening.

7. The control device claimed in claim 6 wherein said base includes a tab extending into said first transverse opening, said tab and said upper portion of said base having a stepped surface thereon, the higher portion of which extends between the periphery of said first electric terminal and said housing in said opening in said housing and in said first transverse opening.

8. In a control device adapted to be energized by a thermocouple and to be connected in circuit with controlling circuit means, a housing having an opening at least an upper portion of which is threaded;

thermocouple connector means threadedly engaged to said upper portion of said opening having an internally threaded bore for receiving coaxial terminal means of said thermocouple;

a first electric terminal spaced from said connector means and said housing having a flexible end disposed below said connector means and in alignment with said bore for connection to one terminal of said thermocouple terminal means and having another end extending externally of said opening and adapted to be connected to said controlling ciruit means;

an insulative base disposed in said opening below said first electric terminal;

a magnetic core member and winding fixed to said base;

a pair of electric terminals connected to opposite ends of said winding and extending outwardly from said base and separated by said base from said first electric terminal; and means connecting one of the electric terminals of said pair of electric terminals to said housing, the other terminal of said pair being adapted to be connected to said controlling circuit means.

9. The control device claimed in claim 8 wherein said means connecting said one electric terminal of said pair of electric terminals to said housing is a screw whereby a positive electrical connection is provided.

10. The control device claimed in claim 8 wherein an upper portion of said base includes means for spacing said first electric terminal from said housing and for preventing movement other than flexing of said first electric terminal when said one terminal of said thermocouple terminal means is connected thereto.

* * * * *